United States Patent [19]

Oxman

[11] Patent Number: 4,811,545

[45] Date of Patent: Mar. 14, 1989

[54] TAG DISPENSING APPARATUS

[75] Inventor: Jack Oxman, Newport Beach, Calif.

[73] Assignee: World Manufacturing, Inc., Costa Mesa, Calif.

[21] Appl. No.: 6,902

[22] Filed: Jan. 27, 1987

[51] Int. Cl.[4] ..... B65B 61/06

[52] U.S. Cl. ..... 53/138 A; 225/52; 225/53; 225/84; 225/83; 225/93; 225/98

[58] Field of Search ..... 225/93, 98, 52–54, 225/23, 84, 88, 93, 98; 53/138 A; 226/147, 151, 127, 128, 196; 221/213, 240, 220; 83/268

[56] References Cited

U.S. PATENT DOCUMENTS

| | | | |
|---|---|---|---|
| 573,524 | 12/1896 | McMaster | 225/88 X |
| 744,244 | 11/1903 | Semmer | 225/98 |
| 901,019 | 10/1908 | Maxon | 225/52 X |
| 972,683 | 10/1910 | De Laney | 225/88 X |
| 1,092,909 | 4/1914 | Hardy | 225/53 X |
| 1,931,760 | 10/1933 | Hermansdorfer | 83/268 |
| 2,908,435 | 10/1959 | Fleener | 225/88 X |
| 2,984,397 | 5/1961 | Gillam | 225/53 X |
| 3,295,735 | 1/1967 | Lincoln | 225/52 |
| 3,840,163 | 10/1974 | Diepeveen | 226/151 X |
| 4,563,856 | 1/1986 | Kusters | 53/138 |

FOREIGN PATENT DOCUMENTS

| | | | |
|---|---|---|---|
| 2633013 | 2/1977 | Fed. Rep. of Germany | 225/98 |

OTHER PUBLICATIONS

Sheet advertisement for "Tach-it" by Ben Clements & Sons, Inc., of South Hackensack, N.J.

Sheet advertisement for "1003 (Ten-o-three) semi-automatic bag closing machine" by Kwik Lok Corporation, of Yakima, Wash.

*Primary Examiner*—Frank T. Yost

*Assistant Examiner*—Hien H. Phan

*Attorney, Agent, or Firm*—Gordon L. Peterson; Loyal M. Hanson

[57] ABSTRACT

An apparatus for dispensing closure tags, includes a support structure on which is mounted a channel member defining first and second channels through which to feed a strip of closure tags. The forward end of the second channel is disposed slightly ahead of the forward end of the first channel to enable placement of a bag into the first tag while a substantial portion of the lower edge of the first tag is still disposed within the second channel. A guide member attached to the channel member defines a surface disposed generally ahead of and facing the second channel that includes a first portion extending from a first position that is generally directly ahead of the forward end of the second channel a distance slightly less than the tag width to a second position that is disposed sideways from the longitudinal axis of the second channel. As the first tag is pulled from the channel member, it is guided sideways by the surface to thereby bend the tag sideways slightly before it is pulled completely from the second channel so that the first tag tends to fold where it is attached to the forward edge of the adjacent tag when the first tag is pulled completely from the second channel. A window may be provided in the channel member to provide access to the tags, and a spring finger to engage the tags and thereby inhibit rearward movement.

15 Claims, 2 Drawing Sheets

Fig. 1
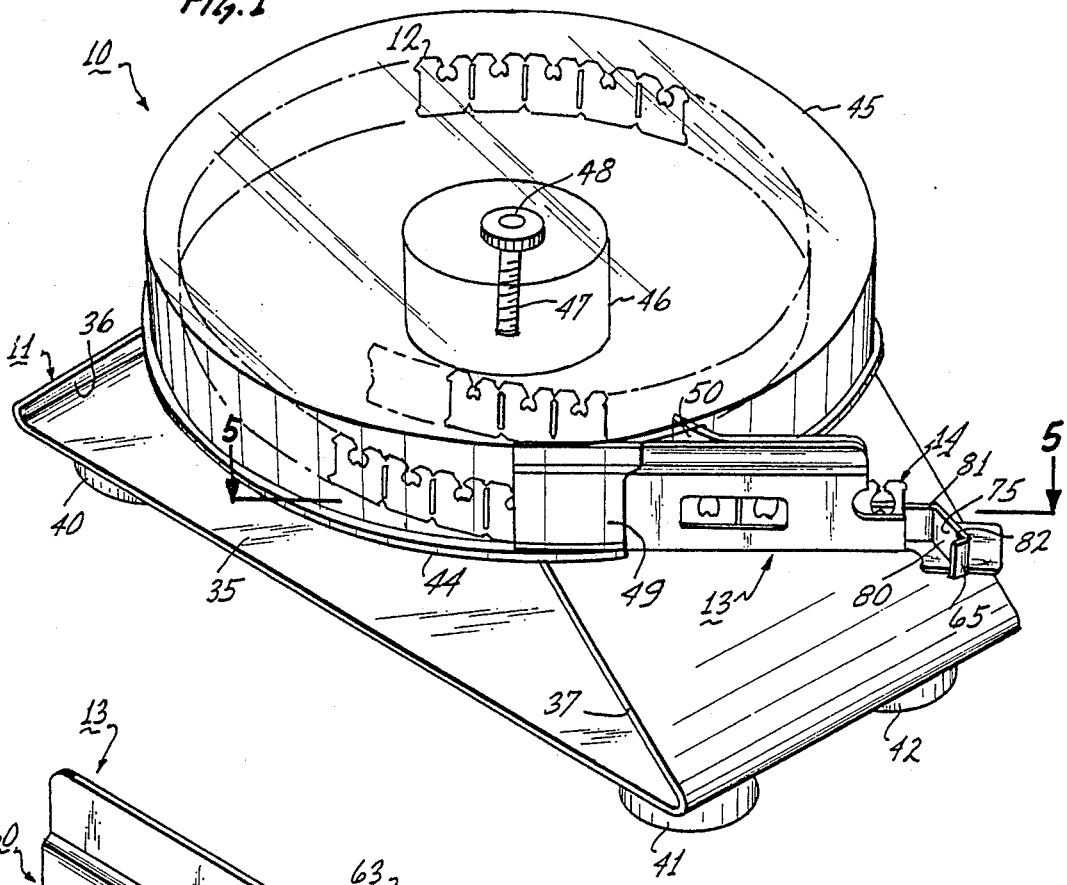
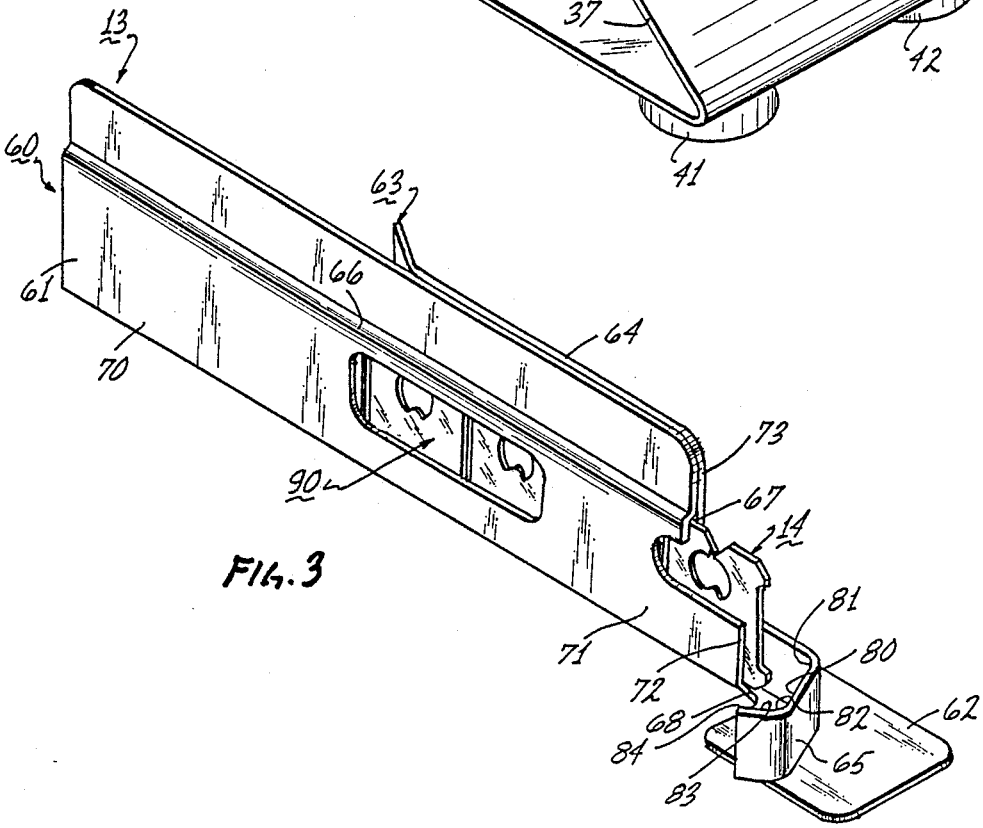
Fig. 3

TAG DISPENSING APPARATUS

BACKGROUND OF THE INVENTION

1. Technical Field

This invention relates generally to bag closure tags, and more particularly to a new and improved apparatus for dispensing such tags.

2. Background Information

Closure tags include the familiar postage-stamp-size plastic devices commonly employed in commercial establishments such as food stores. They are used to retain the neck of a bag securely in a closed or collapsed configuration. One simply places selected articles in one of the plastic bags provided by the store, twists the neck of the bag closed, and then places a closure tag over the twisted neck. This secures the bag quickly, conveniently, and with little associated cost.

Conventional closure tags, such as those sold under the tradenames "KWIK LOCK" and "STRIPLOCK" by Kwik Lok Corporation of Yakima, Wash., typically take the form of a generally rectangular, thin plastic plate that is approximately twenty to twenty-five millimeters on each side. The plate includes a central opening and a narrow slit through which to insert the neck of the bag into the opening. A triangular notch at the tag periphery guides the twisted neck of the bag into the narrower slit, and then the neck is forced along the slit into the central opening where it is securely retained.

A quantity of these tags is often fabricated in a unitary strip so that the individual tags are connected together like a roll of stamps or tickets. Small interconnecting ears extending between adjacent tag peripheries provide a relatively weak connection between adjacent ones of the tags, and this facilitates manual separation. Folding two adjacent tags relative to one another where they are attached together causes the interconnecting ears to break, and in this manner one tag is separated from the strip.

To further facilitate dispensing, the strip is often formed into a coil and placed in a dispensing device. Thus, the user can withdraw a tag from the coil when needed and break it free for use. However, existing devices intended for use in dispensing a coil of closure tags have certain drawbacks that need to be overcome.

For example, U.S. Pat. No. 4,563,856 to Kusters describes a bag closing apparatus whereby individual tags are dispensed from a coil. The tags are advanced along a channel to a stop member disposed perpendicular to the channel axis where they are torn off as used.

In operation, the most forward tag or first tag in the strip is supposed to be positioned in a loading position set back from the stop member such that the triangular notch is flush with an inclined surface on the device. The bag to be closed is slid down the inclined surface into the triangular notch of the forward tag, and the tag is advanced in the same motion to the stop. Here, the bag is pulled perpendicular to the channel axis to separate the first tag from the next or second tag in the roll, with the intention of leaving the second tag so that it is set back from the stop in the loading position.

However, the first tag often does not separate as intended. Instead, the first and second tags remain together, with the second tag breaking free from the third tag in the strip. Not only does this result in waste, but it often leaves the third tag in an inaccessible position within the channel. The inclined surface prevents insertion of another bag into the third tag, and the position of the third tag within the channel prevents grasping the tag with the fingers to advance it to the loading position. Thus, the dispenser must be reloaded or otherwise manipulated to reposition the tags for use.

Consequently, it is desirable to have a new and improved tag dispensing apparatus that overcomes this concern—one with features facilitating separation of just one tag at a time. In addition, it is desirable to have such an apparatus that enables more convenient advancement of the tags in the event the first tag in the strip does become set back within the channel.

Besides the dispensing of two tags at a time, other factors may cause the forward tag of the strip to become set back within the channel. For example, users of the dispenser device may accidentally push the first tag back into the channel, or manipulate the coil of tags for various reasons and thereby withdraw the first tag into the channel. This makes it necessary to again rethread the device.

Although, the device sold by Kwik Lock Corporation under the brandname "1003 (TEN-O-THREE) SEMI-AUTOMATIC BAG CLOSING MACHINE" includes a pair of spring biased jaws designed to inhibit rearward movement, this technique needs improvement. The opposing jaws travel in the plane of the tags to a locking position in which they seat in the space between two adjacent tags. In this position, the jaws contact the peripheries of the tags to inhibit rearward movement. However, they equally inhibit forward movement, and they often disengage by a cam-like action of the tags as the tags are moved rearwardly. Therefore, it is desirable to have a new and improved tag dispensing apparatus that alleviates this concern also, by inhibiting access to the coil of tags and by opposing rearward movement of the tags back into the channel without impairing forward movement.

SUMMARY OF THE INVENTION

This invention recognizes the problems associated with the prior art and provides a new and improved container with the desired attributes.

Briefly, the above and further objects of the present invention are realized by providing a tag dispensing apparatus featuring a stress-inducing cam surface that facilitates one-tag-at-a-time dispensing. In addition, a tag access window and unidirectional tag engagement arrangement according to other aspects of the invention, combine with a covered enclosure to provide a superior device for dispensing closure tags.

Generally, the apparatus includes a support structure adapted to support a conventional strip of interconnected closure tags. Such tags have a pair of oppositely disposed first and second edges separated by a tag height, an opening accessible through the first edge into which to insert a bag to be closed, a pair of oppositely disposed forward and rearward edges separated by a tag width, the rearward edge of which is attached breakably to the forward edge of an adjacent tag in the strip of closure tags, and a pair of oppositely facing sides separated by a tag thickness.

A channel member mounted on the support structure provides a guide through which to feed the strip of closure tags. It defines a pair of first and second generally parallel, elongated channels adapted to slidably receive respective ones of the first and second edges of the tags. Thus, the strip of closure tags can be threaded into one end of the channel member for dispensing one tag at a time from the other end.

The forward end portion of the channel member defines a forward end of the second channel that is disposed slightly ahead of the forward end of the first channel. This leaves access to the opening in each tag unimpaired to thereby enable placement of a bag into the opening in the most forward or first one of the strip of closure tags while a substantial portion of the lower edge of the tag is still disposed within the second channel.

A generally rigid guide member attached to the channel member defines a surface disposed generally ahead of and facing the second channel. The guide member guides the forward edge of the first tag as it is pulled from the channel member. Preferably, a bag is inserted into the opening in the first tag, and the combination of the bag and tag is pulled or slid forwardly manually to do this.

A first portion of the surface on the guide member extends from a first position that is in line with a longitudinal axis of the second channel and ahead of the forward end of the second channel a distance slightly less than the tag width, to a second position that is disposed sideways from the longitudinal axis of the second channel. So disposed, the surface on the guide member serves a stress-inducing function. It guides the forward edge of the forward tag sideways as the forward tag is pulled from the channel member, thereby causing the forward tag to bend sideways slightly before being pulled completely from the second channel. Stressed in this manner, the forward tag tends to fold where it is attached to the forward edge of the next tag when the first tag is pulled completely from the second channel. This initial folding action facilitates separation of the tag from the strip where desired.

Another aspect of the invention provides a second portion of the surface on the guide member that extends from the second position to a third position disposed rearwardly from the second position. So disposed, the second portion of the surface serves a folding function. It guides the forward edge of the first tag rearwardly as it is pulled further from the second channel, thereby causing the first tag to fold even more. This additional folding action further facilitates separation where desired.

Yet another aspect of the invention provides a forward end of the first channel that is separated from the second channel by a distance only slightly greater than the tag height. This inhibits relative movement of the next or second tag within the channel member to thereby inhibit separation of the second tag from the strip of closure tags before the first tag is removed and the second tag advances to a position such that the forward edge is in an accessible position ahead of the forward end of the first channel. In other words, the first tag breaks off by itself instead of two tags breaking off together. Thus, the forward edge of the next tag on the strip, the third tag, is not left in an inaccessible position within the channel member.

The tag access window aspect of the invention provides an aperture in the channel member through which to engage the strip of closure tags for the purpose of advancing the strip within the channel member, and the unidirectional tag engagement aspect provides a leaf spring member attached to the channel member that seats between the forward and rearward edges of adjacent tags to inhibit rearward movement of the strip without impairing forward movement. In addition, the covered enclosure aspect provides a transparent cover member that inhibits unauthorized access to the strip of closure tags while enabling visual monitoring of the number of tags remaining in the strip.

Thus, the device of this invention overcomes many drawbacks of existing devices. The novel stress-inducing portion of the cam surface facilitates separation of just one tag at a time, and the folding arrangement and channel spacing further this purpose. In addition, the tag access window aspect of the invention enables more convenient advancement of the tags in the event the forward tag of the strip does become set back within the channel, and the unidirectional engagement arrangement functions more desirably. Moreover, the covered enclosure combines with the other features of the described apparatus to further improve overall performance.

The above mentioned and other objects and features of this invention and the manner of attaining them will become apparent, and the invention itself will be best understood, by reference to the following description taken in conjunction with the accompanying illustrative drawings.

BRIEF DESCRIPTION OF THE DRAWINGS

FIG. 1 of the drawings is an isometric view of a tag dispensing apparatus constructed according to the invention;

FIG. 3 is an enlarged detail view of the channel member of the apparatus of FIG. 1;

DESCRIPTION OF THE PREFERRED EMBODIMENTS

Figures 2, 4, 5:
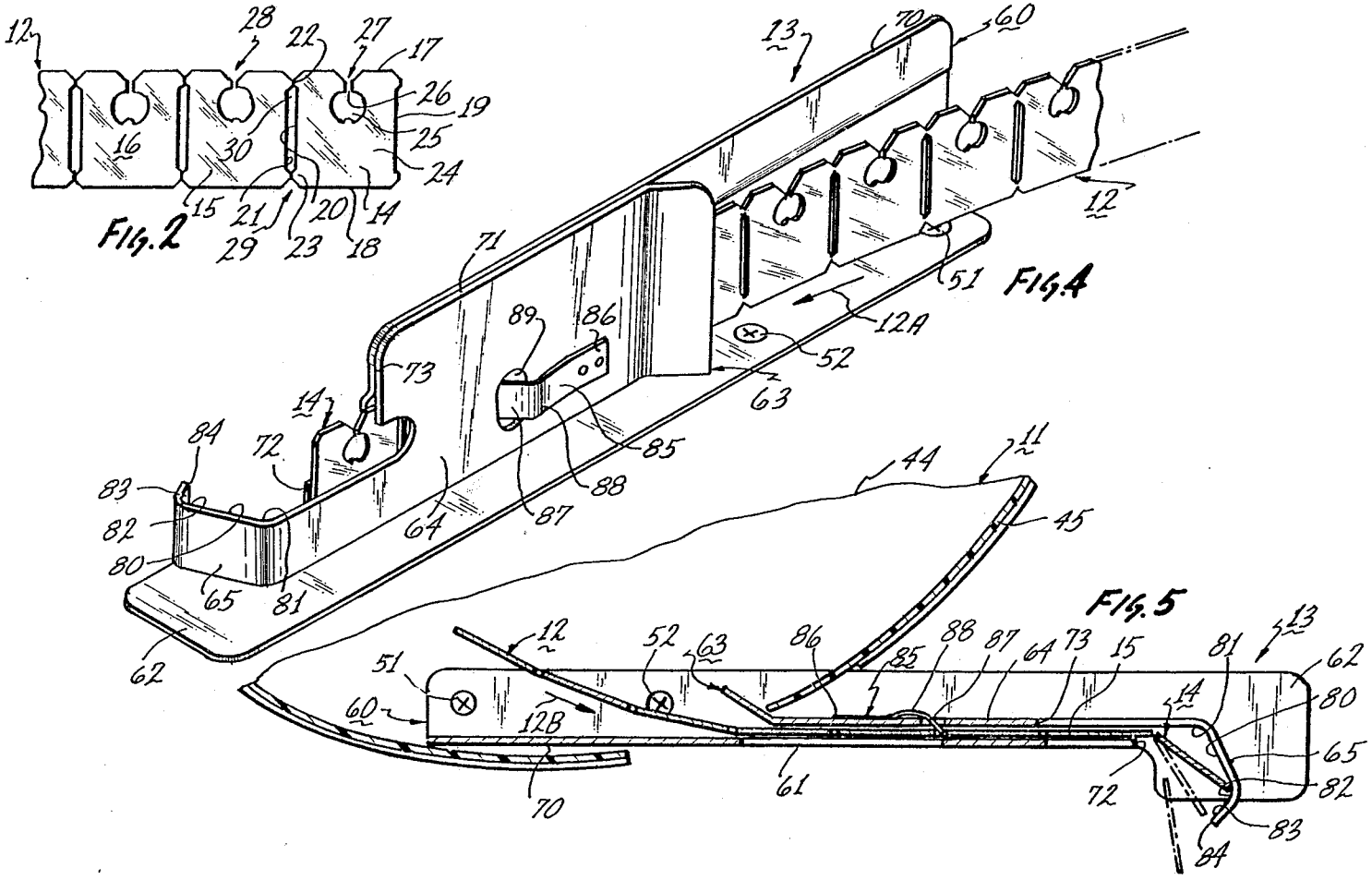
FIG. 2 is an enlarged detail view of a portion of the strip of closure tags.
FIG. 4 is a further enlarged view of another side of the channel member.
FIG. 5 is a cross sectional view of the channel member taken on line 5—5 of FIG. 1.

Referring now to the drawings, there is shown a new and improved apparatus 10 constructed according to the invention. Although the apparatus 10 is adapted for use with a particular size of closure tags, the inventive concepts disclosed are equally applicable any of various sizes and shapes the components may take.

Generally, the apparatus includes a support structure 11 adapted to support a strip 12 of interconnected closure tags, and a channel member 13 through which to feed the strip 12 of closure tag so that individual ones of the tags, such as tag 14 in FIG. 1, can be quickly and conveniently separated from the strip 12 one tag at a time.

Considering first the strip 12 of closure tags, it comprises a plurality of plastic tags integrally formed into a strip so that individual ones of the tags can be separated from the strip as needed. The strip may be folded into sections or coiled in a storage section in the manner of strip 12 in FIG. 1. Each of the tags is generally similar, so that only the tag 14 is described in detail.

The most forward or first tag 14 of the strip 12 is shown in the enlarged detail view of FIG. 2, along with the next or second tag 15 and the third tag 16. The tag 14 has an upper or first edge 17 and a lower or second edge 18 separated by a tag height. The height of each tag in the illustrated strip 12 is approximately 22 millimeters, but this may vary according to the particular type of tag utilized. The apparatus 10 is dimensioned accordingly.

The tag 14 includes a pair of oppositely disposed forward and rearward edges, forward edge 19 and rearward edge 20, separated by a tag width of approximately 18 millimeters. The tag width may vary for different types of tags also. The rearward edge 20 of tag 14 is attached to a forward edge 21 of tag 15 by a pair of breakable or frangible interconnecting portions or connecting regions 22 and 23 of the tag 14 that are attached to similar portions of tag 15. In addition, the tag 14 has a pair of oppositely facing sides of which only the side 24 is visible in FIG. 2, and these are separated by a tag thickness of approximately one millimeter for the tags in the illustrated strip 12.

The tag 14 includes an opening 25 connected by slit 26 to notch 27 so that the opening 25 is accessible through the upper or first edge 17 of the tag 14. To secure a bag with the closure tag 14, the twisted neck of the bag is inserted in notch 27 and forced through slit 26 into opening 25 where it is held compressed in a closed configuration. Then, the tag 14 is separated from the strip 12.

With the tags arranged in the strip 12 in this manner, there is defined a pair of recesses between adjacent tags, such as the recesses 28 and 29 between tags 14 and 15. In addition, there is defined a space between adjacent tags such as the space 30 between tag 14 and 15 that may be on the order of one to one and one-half millimeter between the two tags. In order to separate the tag 14 from the tag 15, the tag 14 is folded at the space 30 and the recesses 28 and 29 so that the interconnecting portions 22 and 23 of the tag 14 break apart from the tag 15. This is easily done, since the interconnecting portions are relatively weak.

Thus, the tags provide a relatively inexpensive means of quickly and conveniently retaining a bag in a closed configuration, and this is further facilitated when the tags are dispensed with the apparatus 10. The support structure 11 of the apparatus 10 (FIG. 1) includes a base 35 to which is attached a pair of sides 36 and 37. A plurality of suction cup feet, such as feet 40–42, are attached to the base 35 by suitable means such as a nut and bolt combination, and a generally flat, circular plate 44 is attached to the sides 36 and 37 to provide a platform on which to place the strip 12 of closure tags.

In the illustrated embodiment, the base 35 and sides 36 and 37 are of unitary construction, formed from a thirteen centimeter wide by fifty centimeter long plate of two millimeter thick steel bent into the trapezoidal-shaped configuration illustrated. The circular plate 44 is a steel plate of similar thickness which is attached to the sides 36 and 37 by suitable means such as spot welding. Of course, other suitable components can be employed to form a suitable support structure within the inventive concepts disclosed.

Thus, the support structure 11 provides the lightweight, inexpensive support for the strip 12, and it is provided with a transparent cover 45 that sits atop the circular plate 44 to enclose the strip 12. A plastic hub 46 having the shape of an inverted cylindrical-cup is disposed over a threaded plastic shaft 47 screwed into the plate 44. Here, it serves as a hub for the strip 12 which is disposed on the plate 44 in a coil around the hub 46.

The threaded shaft 47 is screwed into the plate 44, the hub 46 is placed over the shaft 47, and with the strip 12 in place, the cover 45 is set in place and secured with a knurled plastic nut 48. Thus, the strip 12 is enclosed to inhibit unauthorized access. A cut-out portion 49 in the cover 45 provides an opening 50 through which the channel member 13 extends, from inside the cover 45 where it is secured to the circular plate 44 by suitable means such as screws 51 and 52 (FIGS. 4 and 5).

Further details of the channel member 13 are illustrated in FIGS. 3–5. It includes a steel plate 60 bent to form a first side 61 and base member 62. A second steel plate 63 bent to form a second side 64 and the guide member 65 is attached to the first plate 60 by suitable means such as spot welding, and a bend 66 in the plate 60 results in space between the first side 61 and second side 64 sufficient to permit the strip 12 to be threaded between the two sides, i.e., slightly greater than the tag thickness.

The sides 61 and 64 define a first channel 67 and second channel 68 (FIG. 3) that extend longitudinally from a rearward portion 70 of the channel member 13 to a forward portion 71 that extends outside of the cover 45. The channels 67 and 68 are generally parallel and spaced apart slightly more than the tag height so that they slidably receive respective ones of the first and second edges of the tags in the strip 12 when the strip is threaded into the channel member 13. Thus, the channel member 13 serves to guide the strip 12 of closure tags between the plates 60 and 63 within the first and second channels 67 and 68 from the rearward portion 70 of the channel member 13 to the forward portion 71 along the direction indicated by arrow 12A in FIG. 4 and arrow 12B in FIG. 5.

The forward portion 71 of the channel member 13 defines a forward end 72 of the second channel 68 that is disposed slightly ahead of a forward end 73 of the first channel 67. Thus, when the strip 12 is threaded into the channel member 13 and advanced so that the forward edge 19 of the tag 14 is in proximity with the forward end 72 of the second channel 68 (FIGS. 3 and 4), the notch 27 is in a position beyond the forward end 73 of the first channel 67 so that the neck of a bag to be closed (not shown) can be inserted into the opening 25.

By this arrangement, the bag can be placed into the opening 25 while a substantial portion of the second edge 18 of the tag 14 is still disposed within the second channel 68. This inhibits movement of tag 14 to prevent separation from the strip 12 until desired. The spacing between the first and second channels 67 and 68 at the forward end 73 of the first channel 67 also serves this function. At this point the channels are spaced just slightly more than the tag height, unlike some existing devices, and this further inhibits movement of the tag 14.

Once the bag is inserted into the opening 25, the bag and tag 14 are pulled or slid forward so that the forward edge 19 of the tag 14 contacts the surface 75 on the guide member 65 (FIG. 1). The surface 75 is disposed generally ahead of and facing the second channel 68 and it serves the function of guiding the forward edge 19 of the tag 14 to facilitate tag separation. It includes a first portion 80 along which the forward edge 19 is guided from a first region of the surface 75, or first position 81, to a second region of the surface 75, or second position 82.

The first position 81 is generally directly ahead of the forward end 72 of the second channel 68 a distance slightly less than the tag width. In this position, the forward edge 19 of the tag 14 contacts the first portion 80 before the tag 14 is pulled completely from the second channel 68. The second position 82 to which the first portion 80 of the surface 75 extends is disposed sideways from the longitudinal axis of the second channel 68. It is disposed sideways in the sense that it is spaced apart from the plane of face 24 of the tag 14.

Thus, the first portion 80 extending between these two positions serves the function of guiding the forward edge of the tag 14 sideways as the tag 14 is pulled further from the channel member. This causes the tag 14 to bend sideways slightly before being pulled completely from the second channel. Pre-stressed in this manner, the tag 14 tends to fold where it is attached to the forward edge of the second tag 15 when the tag 14 is pulled completely from the second channel 68.

Preferably, the second position 82 is further ahead of the second channel 68 than is the first position 81. With the first portion 80 of the surface 75 inclined in this manner, the strip 12 advances sufficiently as the tag 14 is pulled forwardly and sideways so that the forward edge 21 of the second tag 15 advances to the forward end 72 of the second channel 68 as the forward edge 19 of the tag 14 is guided to the second position 82.

As this occurs and the rearward edge 20 of the tag 14 leaves the second channel 68, the tag 14 elastically recovers, or unbends. This happens because the second channel 68 no longer restricts the tag 14, and the forces that had caused the tag 14 to bend sideways cause the relatively weak interconnecting members 22 and 23 to fold instead (FIG. 2). Thus, the novel guide member of this invention pre-stresses the tag 14 to cause an initial folding action that achieves the desired separation, one tag at a time.

Once the forward edge 19 of the tag 14 has been advanced to the second position 82, the tag 14 is folded rearwardly further to complete the separation, leaving the second tag 15 in position to be used. The surface 75 of the illustrated embodiment includes a second portion 83 that serves to facilitate this additional folding action.

The second portion 83 extends from the second position 82 described above to a third region of the surface 75, or third position 84, that is disposed rearwardly from the second position 82. The second portion 83 of the surface 75 guides the forward edge 19 of the tag 14 rearwardly as the tag 14 is pulled further from the channel member 13, and this causes the tag 14 to fold rearwardly as indicated in phantom lines in FIG. 5. The combination of the initial folding action and subsequent additional folding action provides a far superior dispensing arrangement.

This folding action is augmented by a unidirectional tag engagement arrangement that includes an elongated member 85 attached to the channel member 13 (FIGS. 4 and 5). The member 85 is composed of a resiliently deformable material, such as spring steel, and it extends from a first end portion 86 to a second end portion 87. The first end portion 86 is attached to the second side 64 of the channel member 13 by suitable means such as spot welding so that the member 85 extends alongside the channel member 13 with the second end portion 87 disposed toward the forward portion 71.

A bend 88 in the member 85 offsets the second end portion 87 so that it extends through an opening 89 in the channel member 13 and seats in the space between adjacent tags corresponding to the space 30 between tags 14 and 15. When the strip 12 is advanced forwardly, the second end portion 87 is cammed out of engagement. However, an attempt to move the strip 12 rearwardly causes the second end portion 87 to remain seated. Unlike some existing devices that utilize opposing jaws adapted to extend into the recesses 28 and 29 (FIG. 2), the member 85 achieves more positive engagement over a greater contact area. This significantly inhibits rearward movement of the strip 12 without impairing forward movement.

The channel member 13 also includes an opening 90 in the first side 61 that serves the function of enabling access to a portion of the strip 12 within the channel member 13. Thus, the strip 12 can be advanced, if necessary, without removing the cover 45. This may be desirable when the most forward tag is not fully advanced to an accessible position beyond the forward end 72 of the channel member 13, such as may occur if a defective tag separates from the strip 12 within the channel member 13.

Thus, the device of this invention overcomes many drawbacks of existing devices. The novel guide member inhibits removal of more than one tag at a time. The stress-inducing portion of the cam surface facilitates separation of just one tag at a time, and the folding arrangement and channel spacing further this purpose. In addition, the tag access window aspect of the invention enables more convenient advancement of the tags in the event the forward tag of the strip does become set back within the channel, and the unidirectional engagement arrangement functions more desirably. Moreover, the covered enclosure combines with the other features of the described apparatus to further improve overall performance.

Although an exemplary embodiment of the invention has been shown and described, many changes, modifications, and substitutions may be made by one having ordinary skill in the art without necessarily departing from the spirit and scope of this invention.

What is claimed is:

1. An apparatus for dispensing closure tags, comprising:

a support structure adapted to support a strip of interconnected closure tags, each one of which tags has a pair of oppositely disposed first and second edges separated by a tag height, an opening accessible through the first edge into which to insert a bag to be closed, a pair of oppositely disposed forward and rearward edges separated by a tag width, the rearward edge of which is attached breakably to the forward edge of an adjacent tag in the strip of closure tags, and a pair of oppositely facing sides separated by a tag thickness;

a channel member mounted on the support structure through which to feed the strip of closure tags, the channel member defining a pair of first and second generally parallel, elongated channels adapted to slidably receive respective ones of the first and second edges of the tags and thereby guide the strip of closure tags for dispensing purposes;

a forward end portion of the channel member defining a forward end of the second channel that is disposed slightly ahead of a forward end of the first channel, to enable placement of a bag into the opening in the first one of the strip of closure tags while a substantial portion of the lower edge of the first tag is still disposed within the second channel;

a generally rigid guide member attached to the channel member to define a surface disposed generally ahead of and facing the second channel; and first means, including a first portion of the surface on the guide member that extends from a first position that is generally directly ahead of the forward end of the second channel a distance slightly less than the tag width to a second position that is disposed sideways from the longitudinal axis of the second channel, for guiding the forward edge of the first tag sideways as the first tag is pulled from the channel member and for thereby causing the first tag to bend sideways slightly before being pulled completely from the second channel so that the first tag tends to fold slightly where it is attached to the forward edge of the adjacent tag when the first tag is pulled completely from the second channel.

2. An apparatus as recited in claim 1, wherein:

the first portion of the surface on the guide member extends to a second position that is further ahead of the forward end of the second channel than is the first position.

3. An apparatus as recited in claim 1, further comprising:

second means, including a second portion of the surface on the guide member that extends from the second position to a third position disposed rearwardly from the second position, for guiding the forward edge of the first tag rearwardly as the first tag is pulled further from the second channel and for thereby causing the first tag to further fold where it is attached to the forward edge of the adjacent tag.

4. An apparatus as recited in claim 1, wherein:

the forward end of the first channel is separated from the second channel by a distance only slightly greater than the tag height, to inhibit relative movement of tags within the channels and thereby to inhibit separation of a tag from the strip of closure tags before the rearward edge of the tag is in an accessible position ahead of the forward end of the first channel.

5. An apparatus as recited in claim 1, wherein:

the channel member includes an opening through which a portion of the strip of closure tags within the channel member is accessible for purposes of advancing the strip of closure tags.

6. An apparatus as recited in claim 1, further comprising:

a resiliently flexible, elongated member having a first end portion and a second end portion;

means for attaching the first end portion to the channel member so that the elongated member extends alongside the channel member with the second end portion disposed toward the forward portion of the channel member; and detent means, including a bend in the elongated member, for causing the second end portion to extend through an opening in the channel member and seat between the forward and rearward edges of adjacent tags so that rearward movement of the tags tends to retain the second end portion seated between the tags and forward movement of the tags tends to cam the second end portion from between the tags.

7. An apparatus as recited in claim 1, wherein the support structure includes:

a base member adapted to be set upon a selected surface;

a platform portion of the base member upon which to place a strip of closure tags to be dispensed;

mounting means for mounting the channel member on the platform in a position adapted to guide the strip of closure tags for dispensing purposes; and a transparent cover member removably mounted on the support member over the strip of closure tags, the cover member having a portion defining an opening through which the channel member extends.

8. An apparatus as recited in claim 1, wherein the support structure includes:

a plurality of suction cup feet members adapted to grippingly engage a surface upon which the support structure is placed.

9. An apparatus for dispensing individual tags from a strip of closure tags in which each one of the tags has a pair of oppositely disposed first and second edges separated by a tag height, an opening accessible through the first edge into which to insert a bag to be closed, and a pair of oppositely disposed forward and rearward edges separated by a tag width, the rearward edge of which is attached breakably to the forward edge of an adjacent tag in the strip of closure tags, the apparatus comprising:

a channel member through which to feed the strip of closure tags, the channel member defining a pair of first and second generally parallel, elongated channels adapted to slidably receive respective ones of the first and second edges of the tags and thereby guide the strip of closure tags for dispensing purposes;

a forward end portion of the channel member defining a forward end of the second channel that is disposed slightly ahead of a forward end of the first channel, to enable placement of a bag into the opening in the first one of the strip of closure tags while a substantial portion of the lower edge of the first tag is still disposed within the second channel;

a generally rigid guide member attached to the channel member to define a surface disposed generally ahead of and facing the second channel; and first means, including a first portion of the surface on the guide member that extends from a first position that is generally directly ahead of the forward end of the second channel a distance slightly less than the tag width to a second position that is disposed sideways from the longitudinal axis of the second channel, for guiding the forward edge of the first tag sideways as the first tag is pulled from the channel member and for thereby causing the first tag to bend sideways slightly before being pulled completely from the second channel so that the first tag tends to fold slightly where it is attached to the forward edge of the adjacent tag when the first tag is pulled completely from the second channel.

10. An apparatus as recited in claim 9, wherein:

the first portion of the surface on the guide member extends to a second position that is further ahead of the forward end of the second channel than is the first position.

11. An apparatus as recited in claim 9 further comprising:

second means, including a second portion of the surface on the guide member that extends from the second position to a third position disposed rearwardly from the second position, for guiding the forward edge of the first tag rearwardly as the first tag is pulled further from the second channel and for thereby causing the first tag to further fold where it is attached to the forward edge of the adjacent tag.

12. An apparatus as recited in claim 9, wherein:

the forward end of the first channel is separated from the second channel by a distance only slightly greater than the tag height, to inhibit relative movement of tags within the channels and thereby to inhibit separation of a tag from the strip of closure tags before the rearward edge of the tag is in an accessible position ahead of the forward end of the first channel.

13. An apparatus for dispensing a strip of closure tags which includes a plurality of closure tags and frangible connecting regions for joining adjacent closure tags together, said apparatus comprising:

a storage section for storing the strip of closure tags;

means for guiding the strip of closure tags from the storage section forwardly along a path to a dispensing location at which the tags can be dispensed from the guide means;

said guiding means includes means responsive to the forwardmost tag of the strip approaching said location for bending the connecting region between such forwardmost tag and the adjacent tag whereby such connecting region is stressed;

said guiding means including means for guiding the forwardmost tag sideways to stress the connecting region between the forwardmost tag and the adjacent tag; and said guiding means including first and second sides, and said bending means including at least one of said sides terminating in an end and a guide member spaced forwardly from said end and arranged to direct the forward end of the forwardmost tag sideways.

14. An apparatus for dispensing a strip of closure tags which includes a plurality of closure tags and frangible connecting regions for joining adjacent closure tags together, said apparatus comprising:

a storage section for storing the strip of closure tags;

means for guiding the strip of closure tags from the storage section forwardly along a path to a dispensing location at which the tags can be dispensed from the guide means;

said guiding means includes means responsive to the forwardmost tag of the strip approaching said location for bending the connecting region between such forwardmost tag and the adjacent tag whereby such connecting region is stressed; and detent means for allowing unidirectional forward movement of the strip by significantly inhibiting rearward movement of the strip and releasably retaining the strip against forward movement.

15. An apparatus for dispensing a strip of closure tags which includes a plurality of closure tags and frangible connecting regions for joining adjacent closure tags together, said apparatus comprising:

a storage section for storing the strip of closure tags;

means for guiding the strip of closure tags from the storage section forwardly along a path to a dispensing location at which the tags can be dispensed from the guide means;

said guiding means includes means responsive to the forwardmost tag of the strip approaching said location for bending the connecting region between such forwardmost tag and the adjacent tag whereby such connecting region is stressed; and said guiding means including a wall having an opening therein through which the strip is accessible for purposes of advancing the strip of closure tags.

* * * * *